US010518963B2

(12) United States Patent
Donner

(10) Patent No.: US 10,518,963 B2
(45) Date of Patent: Dec. 31, 2019

(54) CARRIABLE SHIPPING BAG AND CARRIABLE SHIPPING BAG SYSTEM FOR TEXTILE PRODUCTS

(71) Applicant: Mettler Packaging LLC, Raynham, MA (US)

(72) Inventor: Rene Donner, Morbach (DE)

(73) Assignee: Mettler Packaging LLC, Raynham, MA (US)

( * ) Notice: Subject to any disclaimer, the term of this patent is extended or adjusted under 35 U.S.C. 154(b) by 0 days.

(21) Appl. No.: 15/725,143

(22) Filed: Oct. 4, 2017

(65) Prior Publication Data

US 2018/0093818 A1 Apr. 5, 2018

(30) Foreign Application Priority Data

Oct. 4, 2016 (EP) ..... 16192183

(51) Int. Cl.

| | |
|---|---|
| ***B65D 85/40*** | (2006.01) |
| ***B65D 85/18*** | (2006.01) |
| ***B65D 33/02*** | (2006.01) |
| ***B65D 33/14*** | (2006.01) |
| ***B65D 65/40*** | (2006.01) |

(52) U.S. Cl.

CPC ..... *B65D 85/185* (2013.01); *B65D 33/02* (2013.01); *B65D 33/14* (2013.01); *B65D 65/40* (2013.01)

(58) Field of Classification Search

CPC ..... B65D 85/185; B65D 85/40; B65D 33/14
USPC ..... 206/278, 276, 287.1, 279; 383/24, 211
See application file for complete search history.

(56) References Cited

U.S. PATENT DOCUMENTS

| | | | | |
|---|---|---|---|---|
| 2,584,722 A * | 2/1952 | London | A47G 25/54 206/278.1 |
| 2,590,462 A * | 3/1952 | Rassenfoss | A47G 25/54 206/287 |
| 3,865,235 A * | 2/1975 | Levy | A47G 25/54 206/286 |
| 4,300,688 A * | 11/1981 | London | A47G 25/36 206/285 |

(Continued)

FOREIGN PATENT DOCUMENTS

| | | |
|---|---|---|
| CH | 523056 A | 5/1972 |
| DE | 8325676 U1 | 1/1984 |

(Continued)

OTHER PUBLICATIONS

International Search Report for Application No. EP 16 19 2183 dated Feb. 8, 2017, 2 pages.

*Primary Examiner* — Sue A Weaver
(74) *Attorney, Agent, or Firm* — Seed IP Law Group LLP

(57) ABSTRACT

A carriable shipping bag contains a closable floor opening and an opening for a clothes hanger hook in the top shipping bag edge. The shipping bag further comprises a carrying device secured in some cases to or forming part of the front or back plastic film wall. Additionally, a carriable shipping bag system includes a carriable shipping bag of the present disclosure and a textile product protective cover, wherein in the top bag edge an opening for a clothes hanger hook is present. The shipping bag and the shipping bag system can be used for the transportation or shipment of textile products, such as for online sales of textile products, wherein in some cases the textile product is already placed on a clothes hanger.

24 Claims, 8 Drawing Sheets

(56) References Cited

U.S. PATENT DOCUMENTS

| | | | | | |
|---|---|---|---|---|---|
| 4,817,791 | A * | 4/1989 | Adams | A45C 3/004 | 206/287.1 |
| 4,927,014 | A * | 5/1990 | Pulichino, Jr. | A45C 3/004 | 190/119 |
| 4,981,255 | A | 1/1991 | Schulz | | |
| 5,031,766 | A * | 7/1991 | Cohen | A45C 3/00 | 190/102 |
| 5,090,559 | A * | 2/1992 | Gendreau | D06F 95/002 | 206/278 |
| 5,358,106 | A | 10/1994 | King et al. | | |
| 5,509,588 | A * | 4/1996 | Kimball | A47G 25/14 | 206/286 |
| 5,547,052 | A * | 8/1996 | Latshaw | A45C 5/14 | 16/113.1 |
| 5,779,111 | A * | 7/1998 | Ball | A45C 13/03 | 223/85 |
| 8,201,684 | B2 * | 6/2012 | Torrellas | A47G 25/54 | 206/279 |
| 8,714,350 | B2 * | 5/2014 | Berglund | B65D 33/12 | 206/278 |
| 2007/0012581 | A1 | 1/2007 | Phillips et al. | | |

FOREIGN PATENT DOCUMENTS

| | | | |
|---|---|---|---|
| EP | 0347629 | A1 | 12/1989 |
| EP | 1 520 805 | A1 | 4/2005 |
| GB | 1330290 | A | 12/1973 |
| GB | 2 339 187 | A | 1/2000 |

* cited by examiner

CARRIABLE SHIPPING BAG AND CARRIABLE SHIPPING BAG SYSTEM FOR TEXTILE PRODUCTS

BACKGROUND

Technical Field

The present disclosure provides a carriable shipping bag, in some cases a textile products carriable shipping bag, such as a textile product carriable shipping bag for online retail, a carriable shipping bag system for textile products and the use of such a shipping envelope and this shipping bag system.

Description of the Related Art

The shipment of basic consumable products and of textile products via shipping companies continues to gain in significance. This is particularly the case with the shipment of individual items of clothing, as often only individual items are sent when manufacturers or retailers ship to consumers. To date this has taken place using cardboard packaging. Cardboard packaging for items of clothing is generally manufactured from voluminous, very rigid carton materials. The resulting amount of waste and the cost of disposing of this are necessarily quite high. In general, cardboard packaging also uses a lot of transport volume. With such cardboard packaging moisture damage cannot be avoided, either. The shipping of cardboard packaging also calls for the involvement of what are known as cardboard packaging distribution centers. The shipment of textile products, in particular of individual items of clothing, still leaves a lot to be desired, however.

Accordingly, there is a need to provide shipping containers that no longer suffer from the stated disadvantages and in some cases allow safe and yet space-saving transport of textile products from mail order sales, in some cases also of individual items of clothing, and which are also for both consumers and transport company workers light and uncomplicated to handle and transport.

BRIEF SUMMARY

Accordingly, the present disclosure provides a carriable shipping bag, in some cases textile product carriable shipping bag, such as a textile product carriable shipping bag for online sales, containing a closable bottom opening with a front plastic film wall and a back plastic film wall, each with opposing side edges, an upper edge and a lower edge, wherein the front plastic film wall and the back plastic film wall are connected with one another, in some cases by way of welding, along their corresponding side edges in each case at least in sections to form opposing first and second bag edges or merge into one another as one piece along their corresponding side edges in each case at least in sections to form opposing first and second bag edges and/or wherein the front plastic film wall and the back plastic film wall, optionally along their corresponding side edges, are connected via a first side wall or first side wall sections and/or via an opposing second side wall or second side wall sections directly or indirectly with one another, and wherein the front plastic film wall and the back plastic film wall are connected with one another along their corresponding top edges, in some cases by way of welding, directly or indirectly, in some cases via a top wall strip, or merge into one another as one piece and form an upper shipping bag edge, wherein the lower edge of the back plastic film wall extends beyond the lower edge of the front plastic film wall and wherein this section of the back plastic film wall extending beyond the lower edge of the front plastic film wall on its inside has at least one first adhesive area, which extends or is spaced apart from one side edge in the direction or as far as the opposing side edge, wherein this section of the back plastic film wall is designed and configured to be secured to the outside of the front or back plastic film wall, in some cases the outside of the back plastic film wall, folding over to close the bottom opening and/or via the at least one adhesive area and wherein the upper shipping bag edge, in some cases substantially centrally, has a pass through opening, optionally for a clothes hanger securing device, in some cases a clothes hanger hook, of a clothes hanger, further comprising at least one carrying device secured to or as part, in particular, of the outside, the front- and/or back plastic film wall, in some cases the back plastic film wall, and/or secured to the opposing side edges of the front- and/or back plastic film wall, in some cases of the back plastic film wall, and/or secured to the first and second bag edges.

BRIEF DESCRIPTION OF THE DRAWINGS

Further features and advantages of the present disclosure are indicated by the following description, in which exemplary embodiments of the present disclosure are explained by way of example using schematic drawings, without thereby restricting the present disclosure. These show as follows.

DETAILED DESCRIPTION

Figure 1:
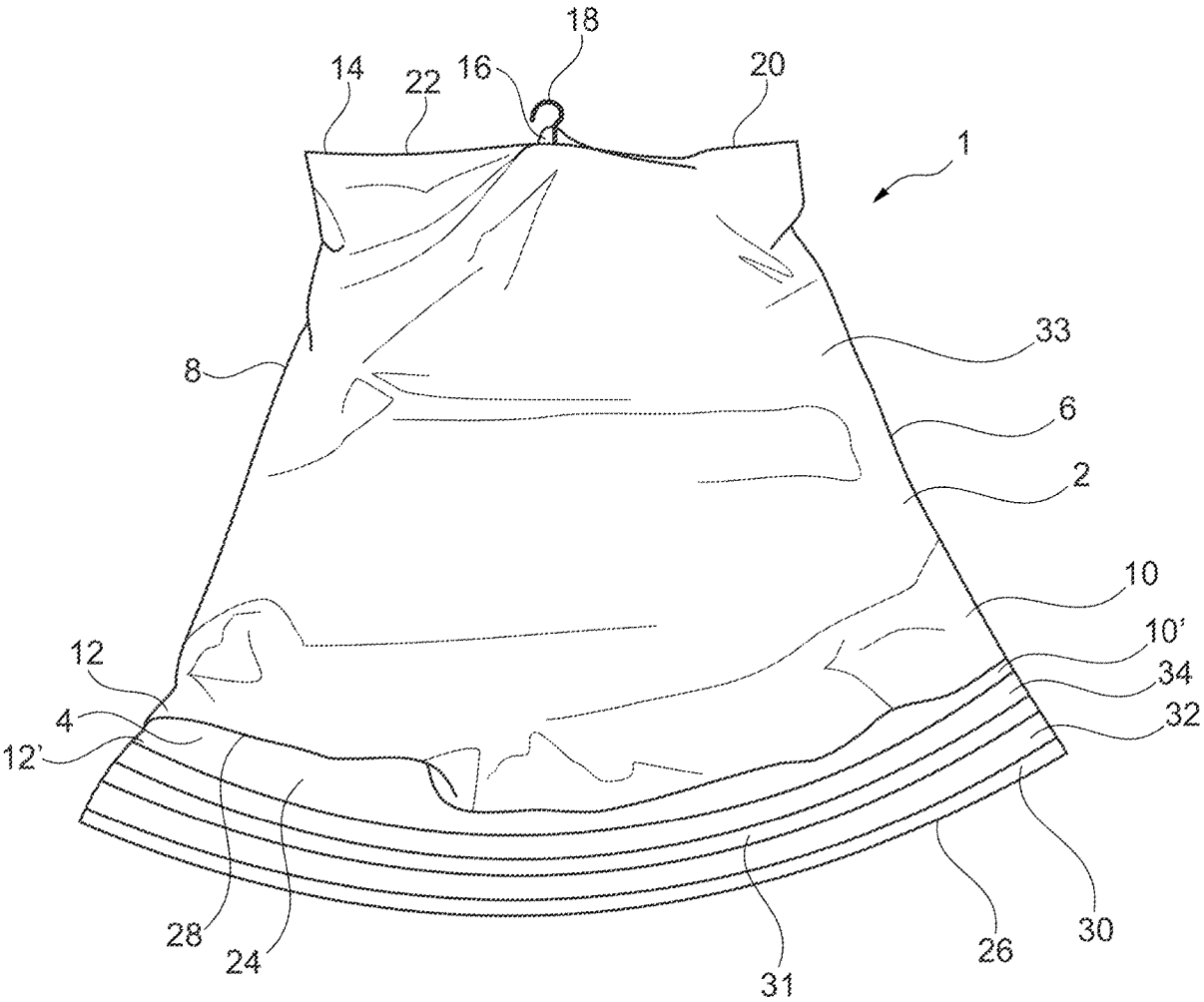
FIG. 1 is a schematic perspective upper view of an embodiment of a shipping bag of the present disclosure.

The carriable shipping bag of the present disclosure can of course also be referred to as a carriable shipping pouch.

Bags with a carrier function, for example with a carrying loop or a grip hole, are routinely referred to as pouches. The intention of the term carriable shipping bag is to convey the impression that this product of the present disclosure on the one hand can be handled like a bag, for example during transport by a shipping company, and on the other that when the carrying device is used it can be employed as a pouch. For the purposes of the present disclosure, the terms "front plastic film wall" and "back plastic film wall" are understood to be relative terms, i.e., these terms could also be replaced by terms such as "first plastic film wall" and "second plastic film wall opposite the first plastic film wall". Accordingly, it is in this connection, by way of example, important that there is a plastic film wall with a section, extending beyond the lower edge of the opposing plastic film wall and on the inside of which there is at least one first adhesive area.

The above statements apply in the same way to the front and back wall of the textile product protective cover.

The terms "lower" and "lowermost" and "upper", by way of example "lower edge", are similarly used for a relative attribution of related structural features of the carriable shipping bag of the present disclosure or the carriable shipping bag system of the present disclosure. Here, for the purposes of the present disclosure the focus is on a carriable shipping bag of the present disclosure and a carriable shipping bag system of the present disclosure, which in a generic fashion is secured or carried by a pass through opening or clothes hanger, the clothes hanger hook of which protrudes through the pass through opening, so that the part hanging down does not touch the bottom. With such a generic use, an upper edge is closer to the clothes hook than a lower edge, for example the lower edge of the back plastic film wall.

The section of the back plastic film wall extending beyond the lower edge of the front plastic film wall, having on its inside at least one first adhesive area, which extends or is spaced apart from a side edge in the direction of or as far as the opposing side edge, is designed and configured here to be folded over the outside of the front and/or back plastic film wall to close the bottom opening and/or to be secured via the at least one adhesive area. Furthermore, the upper shipping bag edge has, in some cases substantially centrally, a pass through opening, which is optionally provided for a clothes hanger hook of a clothes hanger. Furthermore, this pass through opening can also serve for receiving alternative clothes hanger securing devices, for example straps, projections or similar, by way of example a stiff strip of material with a central elevation. Clothes hanger hooks are often made of metal and represent a hazard in such a configuration for items of clothing coming into contact with them.

For the shipping bag of the present disclosure it can be provided for here in an expedient configuration that the upper shipping bag edge on both sides of the pass through opening has an extension, configured and designed to in each case receive an arm of a clothes hanger. Here, the shipping bag of the present disclosure is optionally designed so that clothes hangers of different sizes can be inserted into this shipping bag, wherein the clothes hanger hooks of these clothes hangers can be passed through the pass through opening.

Here, shipping bags of the present disclosure are advantageous in which the front plastic film wall and the back plastic film wall are based on a continuous section of a plastic film, wherein the upper shipping bag edge is an integral, in some cases a one-piece, component of said section of the plastic film.

In order to ensure an adequate seal or safe closing of the shipping bag of the present disclosure, it is routinely provided that the at least one first adhesive area, in some cases at least one first adhesive strip, extends from one bag edge as far as the opposing bag edge.

If items of clothing are ordered online, it can often not be avoided that they will have to be sent back after they have been tried on for the first time. To this end, shipping bags of the present disclosure have proven highly advantageous which are spaced further away from the first adhesive area, and further away from the lower edge of the back plastic film wall than the first adhesive area, have a second adhesive area on the inside on the section of the back plastic film wall, extending beyond the lower edge of the front plastic film wall. This second adhesive area similarly extends or is spaced apart from one side edge in the direction of or optionally as far as the opposing side edge. This also allows the bottom opening to be closed, in some cases by securing to the outside of the back plastic film wall.

The advantageous configuration described above of a shipping bag of the present disclosure is optionally also provided with a weakened zone, also referred to as a first weakened zone, arranged between the first and the second spaced-apart adhesive areas, wherein the second adhesive area runs optionally substantially parallel to the first adhesive area. Furthermore, the shipping bag of the present disclosure can also be provided with a weakened zone, also referred to as a second weakened zone, arranged between the first adhesive area and the lower edge of the back plastic film wall, wherein the first adhesive area optionally runs substantially parallel to the lower edge.

In an expedient arrangement, the shipping bag of the present disclosure is also characterized in that the bottom opening extends between the opposing side edges and is optionally delimited at these side edges by weld seams.

For the front and/or the back plastic film wall optionally an at least three-ply, in some cases an at least five-ply, film composite is used. Here, the layers of these film composites are optionally based on polyolefin films or layers. Of the polyolefin films and layers, polyethylene films or layers are advantageous. The front and back plastic film walls generally have a thickness in the range of 30 to 120 μm and optionally in the range of 40 to 80 μn. Multi-layer plastic film composite systems, by way of example, three- or five-ply plastic film composite systems, are expediently obtained by way of extrusion. Here at least three- or at least five-ply plastic film composite systems are advantageous, where at least one of the middle layers of the film composite is based on recycled polyolefin materials, in some cases recycled polyethylene, optionally recycled polyethylene films. This is on the one hand particularly resource-saving, and on the other can thereby increase the rigidity of the plastic film wall material. Essentially, however, the present disclosure is not restricted to shipping bags and shipping bag systems based on wall materials comprising plastic films. On the contrary, paper or textile wall materials, can be used for example woven or knitted textile materials panels or also wall materials comprising layers of non-woven material. Thus, for the purposes of the present disclosure, features such as front plastic film wall and back plastic film wall can also be understood to be placeholders for paper, textile and non-woven material walls.

The present disclosure further provides a textile product shipping bag, comprising a clothes hanger with a clothes hanger securing device, in some cases with a clothes hanger hook, and with clothes hanger arms extending in opposite directions from the clothes hanger securing device, in some cases the clothes hanger hook, wherein the clothes hanger securing device, in some cases the clothes hanger hook, is present in the pass through opening and wherein the clothes hanger arms on the inside are present adjacent to the upper shipping bag edge or the upper wall strip or rest against it. In shipping, shipping bags of the present disclosure with a textile product attached to the clothes hanger are generally used. This can, by way of example, involve jackets, coats, tailcoats, trousers, suits, dresses, overcoats, shirts, blouses, shawls, T-shirts or pullovers, to name but a few.

The shipping bag of the present disclosure containing a textile product attached to a clothes hanger can be folded, including this textile product, parallel to the upper shipping bag edge. This allows optimum use to be made of the transport volume, without being detrimental to the packaging and/or textile products.

In an advantageous configuration, the shipping bag of the present disclosure also has at least one first reinforced area, extending from or extending spaced apart from a side edge of the front plastic film wall in the direction of or as far as the opposing side edge, and/or at least one second reinforced area, extending from or extending spaced apart from a side edge of the back plastic film wall in the direction of or as far as the opposing side edge, wherein the first and/or second reinforced areas are spaced closer to the lower edge of the front plastic film wall than to the upper shipping bag edge, in some cases in a first, lower folding region of the shipping bag. The first and/or the second reinforced area, in some cases the first and the second reinforced areas, is/are optionally positioned in the area of the front or back plastic film wall, forming a folding region in the at least single-, optionally at least double-folded shipping bag of the present disclosure. This stabilizes the structure of the folded shipping bag of the present disclosure and provides protection from damage caused by the clothes hanger hook during transport and storage of the shipping bag. In the folded state, the clothes hanger hook can be arranged so that this does not protrude into the section for an item of clothing, but is clear of any contact with the item of clothing to be transported, that is to say neither rests on a section of the folded item of clothing, nor is surrounded by this.

Here it can be provided that the first and/or second reinforced area is/are an integral component of the front or back plastic film wall or is/are present on the outside and/or inside of the front plastic film wall or on the outside and/or inside of the back plastic film wall. Optionally, the first and/or second reinforced area is/are present on the inside of the front or back plastic film wall. In this way, the detachment of the reinforced area during transport or due to inappropriate handling is avoided. The first and/or second reinforced areas optionally extend across the full width of the front or back plastic film wall.

In an expedient embodiment it is provided that the first and the second reinforced areas of the front and back plastic film wall during generic use of the shipping bag overlap at least in parts, in some cases are substantially congruent. In this way, more distinctive protection from damage by the clothes hanger hook is achieved. The folded shipping bag of the present disclosure is also significantly stabilized in this way.

Particularly in those embodiments, in which the shipping bag of the present disclosure in the folded transport state has more than one folding region, suitable shipping bags also comprise at least one third reinforced area, extending from or extending spaced apart from a side edge of the front plastic film wall in the direction of or as far as the opposing side edge, and/or at least one fourth reinforced area, extending from or extending spaced apart from a side edge of the back plastic film wall in the direction of or as far as the opposing side edge, wherein the third and/or fourth reinforced areas are spaced closer to the upper shipping bag edge than to the lower edge of the front plastic film wall, in some cases in a second, upper folding region of the shipping bag. Of course, shipping bags of the present disclosure can also be provided with a third and/or a fourth reinforced area, without at the same time having a first and/or a second reinforced area, as previously described.

The carriable shipping bag of the present disclosure is optionally transported in folded form. Here, it can be expediently provided that the shipping bag in folded form has n, in some cases 2 or 3, folding portions, folded along (n−1), in some cases 1 or 2, folding regions, extending from or extending spaced apart from a side or bag edge in the direction of or as far as the opposing side or bag edge, wherein n=2, 3, 4, 5, 6, 7 or 8. In an advantageous configuration, here the folding regions optionally run substantially parallel to the upper shipping bag edge and/or the lower edge of the back plastic film wall and/or the lower edge of the front plastic film wall, optionally substantially parallel to the upper shipping bag edge and the lower edge of the back plastic film wall and the lower edge of the front plastic film wall.

The present disclosure further provides a carriable shipping bag system, comprising a carriable shipping bag of the present disclosure and an, in particular, reclosable, textile product protective cover with a front and a back wall, each with opposing side edges, an upper edge and a lower edge, wherein the front and back wall along their corresponding side edges in each case are joined directly or indirectly with one another or merge into one another as one piece and which along their corresponding upper edges at least in sections are joined directly or indirectly with one another or merge into one another as one piece and form an upper bag edge, wherein this upper bag edge, in some cases substantially centrally, has an pass through opening for a clothes hanger securing device, in some cases a clothes hanger hook, of a clothes hanger. The textile product protective cover can, by way of example, be made from a plastic film. Alternatively, here the protective cover may also be made from woven or knitted panels. The textile product protective cover is generally made to be flexible or pliable.

One embodiment of an expedient shipping bag system of the present disclosure is characterized in that the textile product protective cover at least is present or can be arranged in parts, in some cases completely, in the shipping bag, wherein the front wall of the textile product protective cover is adjacent or can be arranged adjacent to the front plastic film wall of the shipping bag and wherein the back wall of the textile product protective cover is adjacent to or can be arranged on the back plastic film wall of the shipping bag, wherein the upper bag edge of the textile product protective cover is adjacent to or can be arranged or is adjacent to or rests on rests on the upper shipping bag edge of the shipping bag and wherein the pass through opening of the textile product protective cover and the pass through opening of the shipping bag can be or are arranged so that they at least partially, in some cases substantially completely, overlap.

Because the textile product protective cover is designed to be insertable in the shipping bag of the present disclosure, firstly the handling and packing of items of clothing to be transported can be designed to be flexible and safe. Secondly, it is surprisingly possible to transport, without additional cardboard packaging, items of clothing via the regular mail order, without adversely affecting the quality or appearance of these in their original state.

Accordingly, an expedient configuration of the shipping bag system of the present disclosure is furthermore provided with a clothes hanger with a clothes hanger securing device, in some cases with a clothes hanger hook, and with clothes hanger arms extending in opposite directions from the clothes hanger securing device, in some cases the clothes hanger hook, wherein the clothes hanger securing device, in some cases the clothes hanger hook, is present in the pass through opening of the textile product protective cover and of the shipping bag and wherein on the inside the clothes hanger arms are present adjacent to the upper bag edge of the textile product protective cover or rest against this.

Moreover, accordingly in a further expedient configuration, it is provided that the shipping bag of the present disclosure system also comprises a textile product attached to the clothes hanger, in some cases selected from the group consisting of jackets, coats, tailcoats, trousers, suits, dresses, overcoats, shirts, blouses, shawls, T-shirts or pullovers, wherein the clothes hanger securing device, in some cases the clothes hanger hook is present in the pass through openings of the shipping bag and textile product protective cover.

With the shipping bag systems of the present disclosure, the textile product protective cover generally has a lateral extension between the opposing side edges, which is less than the lateral extension between the opposing side edges of the shipping bag. This usually allows practical handling when inserting and removing a textile product-protective cover containing an item of clothing in or from the shipping bag of the present disclosure.

In many transport applications it has proven advantageous for the textile product protective cover to be present in the shipping bag folded once or multiple times. Here, the fold lines are in some cases applied substantially parallel to the upper shipping bag edge and/or the lower edge of the front plastic film wall.

For the handling and safe closing of the shipping bag systems of the present disclosure, those in which the lower edge of the textile product protective cover or the lowermost fold of the textile product protective cover or the textile product attached to the clothes hanger, in some cases the lower edge of this, is present spaced apart from lower edge of the front plastic film wall, have proven advantageous. In this way, the section of the shipping bag containing the front and back plastic film wall, extending from the lower edge or the lowermost fold of the textile product protective cover or the textile product, can be folded without folding the textile product protective cover, at a section of the shipping bag containing the textile product protective cover and/or the textile product.

The shipping bag systems of the present disclosure are optionally transported in the folded state. Here, it can be expediently provided that the shipping bag and possibly the textile product protective cover has n–, in some cases three, folding portions made up of n–1, in some cases two, folds or folding regions, wherein n=2, 3, 4, 5, 6, 7 or 8, in some cases 2, 3 or 4. By way of example, the shipping bag system in folded form may be present with n, in some cases 2 or 3, folding portions, folded along (n–1), in some cases 1 or 2, folding regions, extending from or extending spaced apart from a side or bag edge in the direction of or as far as the opposing side or bag edge, wherein n=2, 3, 4, 5, 6, 7 or 8. In an advantageous configuration here the folding regions optionally run substantially parallel to the upper shipping bag edge and/or the lower edge of the back plastic film wall and/or the lower edge of the front plastic film wall and in some cases substantially parallel to the upper shipping bag edge and the lower edge of the back plastic film wall and the lower edge of the front plastic film wall.

Such shipping bag systems of the present disclosure are characterized by distinctive practicality and stability, with the shipping bag having three folding portions formed by two folds, comprising a first folding portion, extending from the upper shipping bag edge as far as or in the direction of the spaced-apart second folding portion, in some cases as far as the second folding region, a second folding portion attaching to the first folding portion or the second folding region, extending substantially as far as the lower edge of the textile product protective cover or the lowermost fold of the textile product protective cover or the lower edge of the textile product or the first folding region or beyond this and a third folding portion, extending substantially from the lower edge of the textile product protective cover or the lowermost fold of the textile product protective cover, in some cases the second folding portion or the first folding region, as far as the section of the back plastic film wall extending beyond the lower edge of the front plastic film wall. Accordingly, in a further embodiment it can be provided that the shipping bag and possibly the textile bag protective cover has n folding portions formed by (n–1) folds, wherein n may be=3, 4, 5, 6, 7 or 8. Accordingly, the shipping bag system of the present disclosure can comprise an $n^{th}$ folding portion, extending substantially from the lower edge of the textile product protective cover or the lowermost fold of the textile product protective cover, in some cases the $(n-1)^{th}$ folding portion or the $(n-2)^{th}$ folding region, as far as the section of the back plastic film wall extending beyond the lower edge of the front plastic film wall.

In the folded shipping bag system of the present disclosure, in an advantageous configuration the clothes hanger securing device, in some cases the clothes hanger hook, in the folded state is arranged beyond the lower edge or the lowermost fold of the textile product protective cover or the lower edge of the item of clothing and in some cases in the region of the first folding region. In this way, for example, a damaging interaction between the clothes hanger hook and an item of clothing to be transported can be minimized or even prevented. A clothes hanger hook is present for the purposes of the present disclosure in the folded state of the shipping bag or of the shipping bag system beyond the lower edge or the lowermost fold or the lowermost folding region of the textile product protective cover or of the lower edge of the item of clothing, if this completely or partially no longer overlaps with the textile product protective cover and/or the item of clothing.

With the shipping bag of the present disclosure, as with the shipping bag systems of the present disclosure, in an advantageous configuration it can be provided that all folding portions have substantially the same average extension between respectively adjacent folding regions or that all folding portions except for the folding portion containing the section of back plastic film wall extending beyond the lower edge of the front plastic film wall have substantially the same average extension between respectively adjacent folding regions, or that all folding portions except for the section of the back plastic film wall extending beyond the lower edge of the front plastic film wall and the folding portion containing the upper shipping bag edge have substantially the same average extension between respectively adjacent folding regions, or that all folding portions with the exception of the folding portion containing the upper shipping bag edge have substantially the same average extension between respectively adjacent folding regions.

With the shipping bags of the present disclosure, as with the shipping bag systems of the present disclosure in a further advantageous configuration it can be provided that a) the at least one carrying device forms part of or is secured to the folding portion, in some cases to the outside of the back plastic film wall of the folding portion, which contains the lower edge of the section of the back plastic film wall extending beyond the lower edge of the front plastic film wall, or that
b) the at least one carrying device forms part of or is secured to the folding portion, in some cases to the outside of the back plastic film wall of the folding portion, which is adjacent to the folding portion of the back plastic film wall which contains the section of the back plastic film wall extending beyond the lower edge of the front plastic film wall, or that
c) the at least one carrying device forms part of or is secured to the folding region arranged between the folding portion, which contains the section of the back plastic film wall extending beyond the lower edge of the front plastic film wall, and the folding portion adjacent to this, or that
d) the at least one carrying device forms part of or is secured to the folding region adjacent to the folding region according to embodiment c).

Expedient shipping bags and shipping bag systems of the present disclosure are also characterized in that the at least one carrying device present on the folding portion, in some cases on the outside of the back plastic film wall of the folding portion containing the section of the back plastic film wall extending beyond the lower edge of the front plastic film wall, is substantially equally spaced apart from the folding region with the adjacent folding portion and the first or second adhesive area and/or the at least one carrying device present on the folding portion, in some cases on the outside of the back plastic film wall of the folding portion adjacent to the folding portion containing the section of the back plastic film wall extending beyond the lower edge of the front plastic film wall is substantially equally spaced apart from the folding regions delimiting this folding portion. It can be alternatively or additionally provided that the at least two carrying devices present on the folding portion, in some cases on the outside of the back plastic film wall of the folding portion containing the section of the back plastic film wall extending beyond the lower edge of the front plastic film wall, are spaced apart from one another such that their half-distance is substantially equally widely spaced apart from the folding region with the adjacent folding portion and the first or second adhesive area and/or that the at least two carrying devices present on the folding portion, in some cases on the outside of the back plastic film wall of the folding portion adjacent to the folding portion containing the section of the back plastic film wall extending beyond the lower edge of the front plastic film wall, are present spaced apart substantially in such a manner that the half-distance is substantially equally widely spaced apart from the folding regions delimiting this folding portion. If a plurality of carrying devices, optionally two carrying devices, is simultaneously provided for, plastic film strips spaced apart from one another, optionally in the same material as the back plastic film wall, are generally used for this. It has often proved expedient to connect this plurality of carrying devices in the form of plastic film strips in the region of the side edges or of the first and second bag edges with the shipping bag, by way of example to weld these. Of course, it is similarly possible to make a connection between these plastic film strips on the outside of the back plastic film wall spaced apart from the opposing side edges. An embodiment is also advantageous in which the length of the plastic film strips substantially corresponds to the width of the shipping bag, i.e., the distance between the first and second bag edges opposing one another.

Of the shipping bags of the present disclosure and also the shipping bag systems of the present disclosure, embodiments are advantageous in which the at least one carrying device has, in some cases connected to the outside of the back film wall, optionally welded and/or glued, film strips containing a grip hole or an area, in some cases fully or partially circumferentially perforated, forming a grip hole, or a carrying loop. Advantageous are embodiments in which the carrying device has a fully or partially circumferentially perforated area which when pushed-through or destroyed forms or contains, or is formed by, a grip hole. This also includes the use of tear lines and/or partially pre-stamped or cut lines, contouring the grip hole. Accordingly, generally still remains in the grip hole area, i.e., the grip hole area is configured and designed to release a grip hole or push-through for a hand during generic engagement. Here the film strip extends optionally across the full width of the carriable bag and is here in some cases connected with its lower edge with the back film wall. Here, for process engineering reasons, it has proven advantageous to use a substantially rectangular film strip. With this film strip, which is optionally made from the same material as the back plastic film wall, by way of example polyethylene, a grip strap or a grip hole can be present in some cases as a fully or partially circumferentially perforated grip hole, optionally positioned adjacent to the edge of the film strip, opposite the lower edge section connected with the back film wall. In an expedient configuration, the plastic film strip is optionally configured and designed so that it can be positioned on a folding portion, optionally without protruding into a folding region. In this way, it can be avoided that the plastic film strip has to be present in an arched form to follow the course of the folding region. The latter would make handling and the production process more difficult and more prone to failure.

In some expedient configurations of the shipping bag of the present disclosure and of the shipping bag system of the present disclosure, it is provided that the at least one first and/or second adhesive area in the folded state of the shipping bag system is connected with the folding portion containing the upper shipping bag edge or with the folding portions, adjacent to the folding portion containing the upper shipping bag edge. In this way, folded and packaged items, in some cases items of clothing, are obtained which can be easily and safely transported in the folded state.

Here, in an expedient embodiment, the at least one carrying device can be positioned or configured and arranged in such a way that, during generic use, the overlying folding portions of the folded and closed shipping bag can be carried aligned more horizontally than vertically, in some cases substantially horizontally aligned.

Advantageous are embodiments of shipping bags of the present disclosure and shipping bag systems in which the carrying device in the form of a plastic film strip is connected, in some cases welded, via the side turned towards the outside of the back plastic film wall in a first section, in some cases constituting a weld seam or welded area, extending from or extending spaced apart from the first bag edge in the direction of or as far as the second bag edge, with the outside of the back plastic film wall, wherein this first section has a first, lower edge limit, turned towards the lower edge of the back plastic film wall, and an opposing second edge limit, turned towards the upper shipping bag edge, and wherein a second section of the film strip adjoins the first section and contains the grip hole or an area, in some cases fully or partially circumferentially perforated, forming a grip hole or the at least one carrying loop. In some cases in the above-mentioned embodiment, the at least one carrying device can be configured and arranged in a way in which, during generic use, overlying folding portions of the folded and closed shipping bag can be carried aligned more horizontally than vertically, in some cases substantially vertically aligned.

With the advantageous embodiments described above, the carrying device in the form of the film strip can be positioned in a beneficial manner such that the film strip in the folded state of the shipping bag or of the shipping bag system can be positioned flat on a folding portion and is not, for instance, present in a folding region and thus does not take an arched course.

Shipping bags or shipping bag systems of the present disclosure that have proven expedient are those in which the first section of the carrying device connected with the outside of the back plastic film wall extends from the first to the second bag edge or between the first and the second bag edge. Accordingly, the carrying device, in some cases the film strip, can also be present only along a section between the first and the second bag edge, by way of example with an extension, that corresponds to in the region of a quarter to three quarters of the distance between the first and the second bag edge.

In general, in the embodiments of shipping bags of the present disclosure and shipping bag systems of the present disclosure containing a carrying device in the form of a film strip described here, the second section of the carrying device is optionally attached to the first section connected with the front- or back plastic film wall, wherein this first section is turned towards the lower edge or the front or back plastic film wall or the upper shipping bag edge and in some cases is a component of a lower or the upper edge section of the carrying device or forms the lower or upper edge section of the carrying device.

The first section of the carrying device or of the film strip, including where present as a welded seam, has a first, lower edge limit turned towards the lower edge of the back plastic film wall, and an opposing second, upper edge limit, turned towards the upper shipping bag edge. A weld seam can also have a lateral extension. The second section of the carrying device optionally attached to the first, lower edge limit of the carrying device.

Also advantageous are embodiments of shipping bags and shipping bag systems of the present disclosure in which, where the shipping bag or shipping bag system is present in folded form, the first section of the carrying device is present on the folding portion, containing the section of the back plastic film wall extending beyond the lower edge of the front plastic film wall, wherein this first section is present adjacent to the folding region attached to this folding portion, or in which the first section of the carrying device is present adjacent to the folding portion, containing the section of the back plastic film wall extending beyond the lower edge of the front plastic film wall, wherein this first section is present in the transition between this folding portion and the folding region attached to this or in this folding region, optionally on this side or the other side of the crown of the folding region, optionally turned towards the folding portion, containing the section of the back plastic film wall extending beyond the lower edge of the front plastic film wall, or at which the first section of the carrying device is present on the folding portion, adjacent to the folding portion, containing the section of the back plastic film wall extending beyond the lower edge of the front plastic film wall, wherein this first section is adjacent to the folding region extends between this folding portion and the folding portion, containing the section of the back plastic film wall extending beyond the lower edge of the front plastic film wall.

The shipping bag system of the present disclosure can therefore be used, for example, to transport an item of clothing from a central warehouse of a supplier to a store of this company, using a shipping service for example, in order then to be handed over in an unchanged form to a consumer. With the help of the carrying device, the consumer can transport the clothing system protected by the shipping bag system, possibly even together with further products, by way of example foodstuffs, without having to worry about dirtying the newly purchased item of clothing. The advantage of using the shipping bag of the present disclosure and of the shipping bag systems of the present disclosure for transport or shipping companies, is that less storage space is required, but safe transport can nevertheless be ensured, and for the consumer that a new item of clothing can be further transported in a space-saving manner and if necessary actually returned in a simple fashion.

Among the shipping bag systems of the present disclosure, those which due to their stability and transport safety have proven particularly suitable, are the ones in which in the region of the transition between the second and the third folding portion, the first and/or second reinforced area is present and/or in which in the region of the transition between the first and the second folding portion the third and/or fourth reinforced area is present.

Here, for example, it can be provided that at least one first and/or second adhesive area in the folded state of the shipping bag system is connected or connectable with the second folding portion.

The shipping bag of the present disclosure and the shipping bag system of the present disclosure are particularly suitable for the transportation and/or shipping of textile products, and here in some cases for online sales of textile products. A feature of this can be considered to be that the textile product to be transported in the shipping bag, in some cases in the textile product protective cover of the shipping bag of the present disclosure system, is attached to a hanger during transport and storage.

The shipping bag system of the present disclosure allows an extremely efficient, space-saving and yet secure shipment of even very delicate and valuable items of clothing, without the need to use cardboard packaging. Here, a suitable packaging and/or shipping method comprises the following steps:

a) placing an item of clothing on a clothes hanger;

b) inserting the item of clothing present on the clothes hanger into a textile product protective cover, as outlined above, having an pass through opening for a clothes hanger securing device, in some cases a clothes hanger hook;

c) if necessary closing the textile product protective cover and/or if necessary folding the item of clothing together with the textile product protective cover one, two or more times, to form one or more fold lines, running substantially parallel to the upper edge of the textile product protective cover;

d) pushing the clothes hanger securing device, in some cases the clothes hanger hook, through the pass through opening of the textile product protective cover and if necessary placing the clothes hanger arms on the upper bag edge of the textile product protective cover;

e) introducing the if necessary folded textile product protective cover containing the item of clothing into a shipping bag of the present disclosure, wherein the clothes hanger securing device, in some cases the clothes hanger hook, is passed through the pass through opening of the shipping bag and the upper edge of the textile product protective cover on the inside is present adjacent to the upper shipping bag edge or rests against this, wherein the textile product protective cover and the item of clothing present therein are introduced into the shipping bag in such a way that this textile product protective cover and the item of clothing present therein do not extend as far as the bottom opening of the shipping bag, so that a folding portion remains, which is clear of the item of clothing and which is suitable for folding over onto at least one section of the shipping system bag of the present disclosure;

f) folding a section of the shipping bag system containing the clothes hanger securing device present outside of the pass through opening, in some cases the clothes hanger hook, over an adjacent section of the shipping bag system, optionally in such a manner that the clothes hanger securing device, in some cases the clothes hanger hook, protrudes beyond the item of clothing present in the adjacent folding portion;

g) folding the folding portion containing front and back plastic film wall of the shipping bag, in which no item of clothing is present, over the folding portion, containing the pass through openings of textile product protective cover and shipping bag and h) securing the back section, protruding beyond the lower edge of the front plastic film wall, to the outside of the back plastic film wall, in some cases in the first folding portion and/or in the second folding region and/or in the second folding portion of the shipping bag of the present disclosure system.

In an advantageous configuration the section of the shipping bag made of a front and back plastic film wall, in which an item of clothing is no longer present, is folded or turned over the section of the transfer bag of the present disclosure having the clothes hanger securing device, in some cases the clothes hanger hook, wherein in an advantageous embodiment the folding region is present in the region, in which there is contact with the clothes hanger securing device, in some cases the clothes hanger hook, of at least a first and/or second reinforced area.

In a further configuration, it is similarly possible to make the section of the shipping bag, having the bottom opening and in which an item of clothing is no longer present, long enough for this section to not only rest on the folding portion having the pass through openings for the clothes hanger securing device, in some cases the clothes hanger hook, but also to be continued around the second folding region as far as the opposing side, i.e., as far as the first folding portion.

The present disclosure is based on the surprising finding that with the textile product shipping bags, textile products such as coats, jackets, dresses and suchlike, in some cases also in small quantities, by way of example as individual items, can be shipped in a space-saving manner which nevertheless protects the material. Onward or return shipment using the same shipping bag of the present disclosure is also perfectly possible. It has also surprisingly been found that, shipping of textile products using the shipping bag of the present disclosure is possible which does not lead to wrinkling or shifting of the items of clothing during transport. Creasing can also be avoided. Unlike with packaging containers for textile products made from cardboard packaging, the textile products placed in the shipping bag of the present disclosure on a clothes hanger slip very little if at all. It is also of quite some cases advantage that the textile product shipping bag of the present disclosure and also the shipping bag systems of the present disclosure allow shipping of items of clothing together with their clothes hanger, i.e., the items of clothing arranged properly on the clothes hanger and could be easily suspended on a clothes rail. Here, the transported items of clothing are not adversely affected by the clothes hanger securing device, in some cases the clothes hanger hook, of the clothes hanger and/or by the clothes hanger arms, by way of example by damage, creasing or sagging. Adjacent items of clothing, being transported and stored by way of the textile product shipping bag of the present disclosure and in some cases also by way of the shipping bag systems of the present disclosure, remain safe. A further advantage is also provided by the subject matter of the present disclosure in that for the shipping of items of clothing what are known as cardboard packaging distribution centers no longer have to be employed, as mail distribution centers can be used instead. The shipping of items of clothing, in some cases also individual items of clothing, with the help of the shipping bag of the present disclosure and in some cases with the shipping bag system of the present disclosure also takes place without cardboard packaging.

FIG. 1 shows the front view of a shipping bag 1 of the present disclosure. The shipping bag 1 is formed by a front film wall 2, also referred to as a front panel, and a back film wall 4, also referred to as a back panel, which are connected with one another along their opposing side edges 10, 10' and 12, 12' via weld seams 6 and 8. In the region of the upper shipping bag edge 14, the front and the back plastic film walls 2, 4 in the embodiment shown merge into one another as one piece. The textile product shipping bag 1 according to the embodiment shown in FIG. 1 can accordingly be made from a continuous, single material panel. In the region of the upper shipping bag edge 14, the textile product shipping bag 1 is closed except for the substantially centrally arranged pass through opening 16. The pass through opening 16 is designed so that the clothes hanger hook 18 of a clothes hanger can optionally be pushed through without damage and likewise removed again. Here, the sections 20 and 22 of the upper shipping bag edge 14 extending on either side of the pass through opening 16 routinely have a length that is sufficient to receive or rest without restriction on the arms of the clothes hanger (not shown) extending from the clothes hanger hook 18. Apart from the pass through opening 16, the advantageous configuration represented in FIG. 1 of a textile product shipping bag 1 has a bottom opening 24. This bottom opening 24 extends in the embodiment shown from the opposing weld seams 6 and 8 between the front and back plastic film wall. Here, the lower edge 26 of the back plastic film wall 4 extends beyond the lower edge 28 of the front plastic film wall 2 and forms a section 30. On its inside 31, this section 30 is provided with two adhesive areas 32 and 34 spaced apart from one another in the form of adhesive strips, extending from the side edge 10' of the back plastic film wall 4 to the opposing side edge 12'. The bottom opening 24 can be closed by folding down the section 30. In an advantageous configuration (not shown), in the region between the two adhesive areas 32 and 34 the section 30 has at least one tear line. This similarly extends optionally from the first side edge 10' as far as the opposing side edge 12'. This tear line can be used so that the textile product shipping bag 1 can be employed for returning an item of clothing which, by way of example, proves unsuitable once it has been tried on or which is faulty. With this procedure, the adhesive area 32 adjacent to the lower edge 26 in the form of an adhesive strip can initially be used to close the bottom opening 24 of the textile product shipping bag 1, in order to send it to a purchaser, customer or consumer. Once the bag has been opened along the tear line present between the two adhesive areas and the textile product replaced in the opened bag, the further adhesive strip 34 can be used to reclose the bottom opening 24. Prior to their use, the adhesive areas 32 and 34 are advantageously each provided with a protective layer, by way of example with a siliconized paper strip.

Once, by folding down section 30 and sticking it with the help of the adhesive area, in some cases by way of the adhesive area 32, the bottom opening 24 has been closed, the packaged textile product for the purposes of transport can be suspended by the clothes hanger hook 18 protruding through the pass through opening 16 on a clothes rail. Alternatively, it is similarly possible to fold the textile product shipping bag in half, in order to be able to make optimum use of the available transport space. It has often also proven expedient to overlap textile product shipping bags of the present disclosure, containing a textile product attached to a clothes hanger, by a plurality of, optionally substantially the same length, sections, e.g., two or in some cases three sections, i.e., by thirds for example.

In the embodiment of a shipping bag of the present disclosure illustrated in FIG. 1, the carrying device is located on the back plastic film wall and is therefore not apparent from this FIG. 1.

Figure 2:
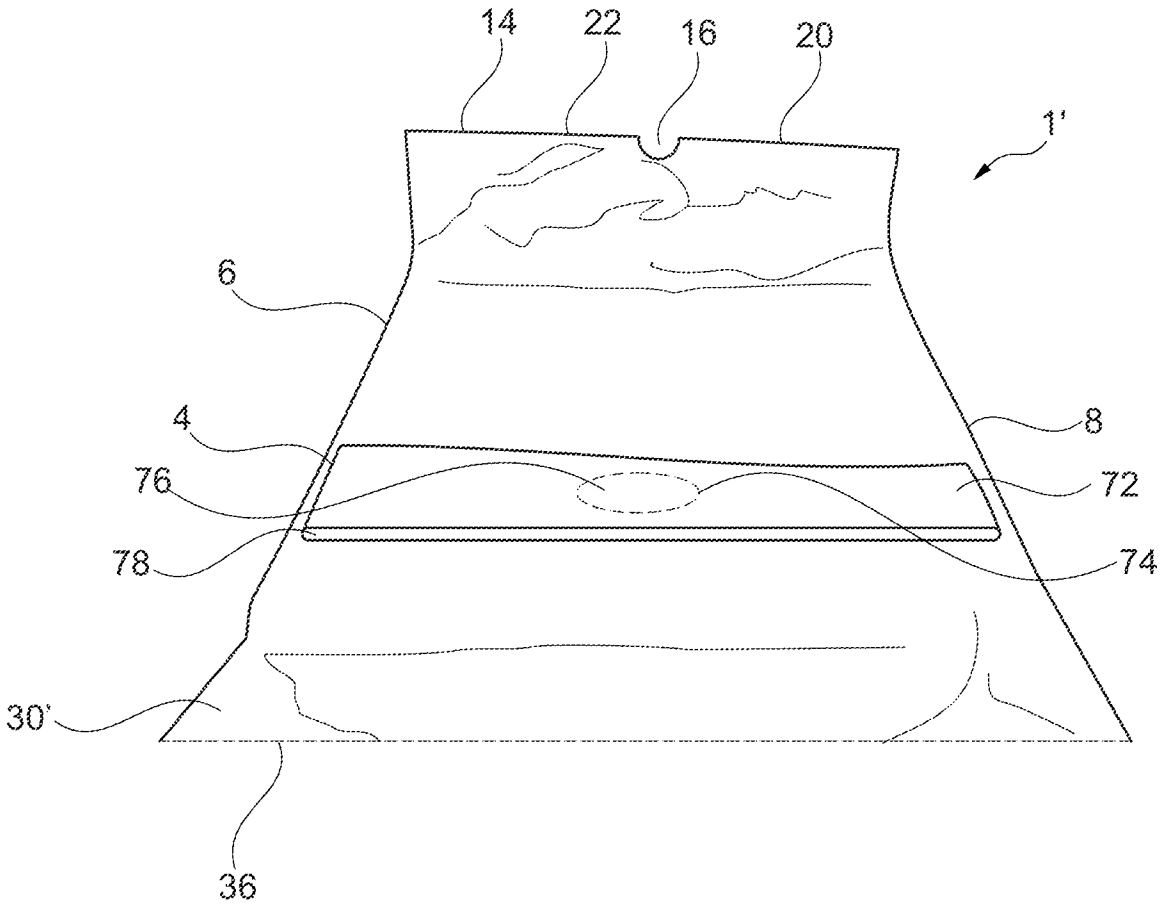
FIG. 2 is a schematic upper view of the back of a further embodiment of the shipping bag of the present disclosure.
Figure 3:
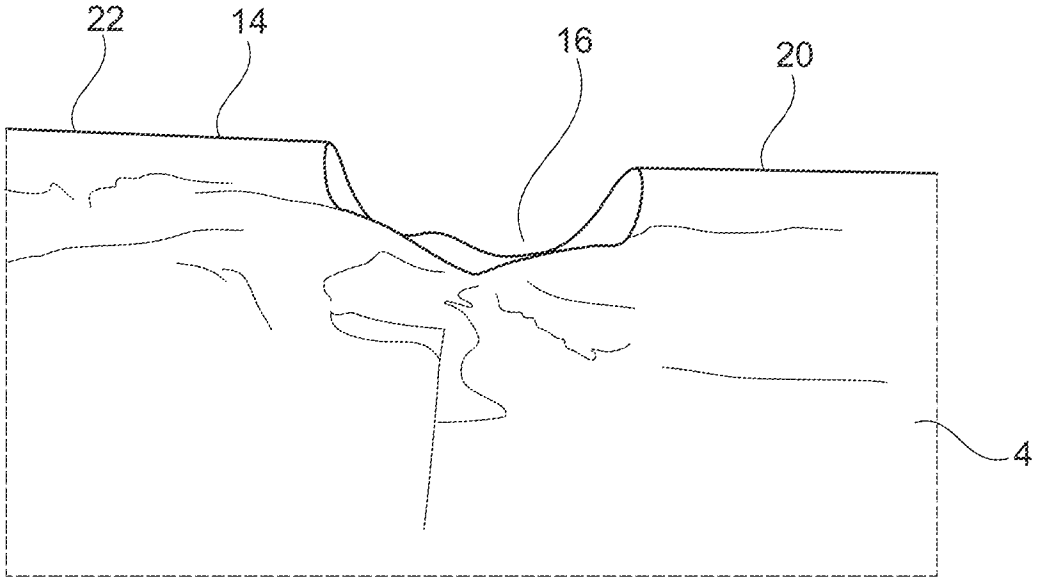
FIG. 3 is a schematic view of a section of the shipping bag according to FIG. 2.

FIG. 2 shows the back view of a textile product shipping bag 1' of the present disclosure. This textile product shipping bag 1' is substantially provided with the same features as the textile product shipping bag 1 according to FIG. 1. This is made clear by the corresponding reference numerals. In the variant illustrated in FIG. 1', the strip of the section 30 containing the adhesive area 32 has been spaced apart along the tear line 36. Thus, in the embodiment according to FIG. 2, the former tear line 36 forms the lower edge of section 30'. Inside, on this section 30' (not shown), the adhesive area 34 is also present, which can now be used by folding the section 30' over the outside of the front plastic film wall to reclose the bottom opening of the shipping bag. FIG. 2 shows the carrying device 72 in the form of a strip of film. This is connected along a first section with the back plastic film wall 4 forming a weld seam 78. In the embodiment variant illustrated, the film strip 72 rests against the outside of the back plastic film wall 4. The plastic film strip 72 contains a second section 86 attached to the weld seam or the first section or second section 86, in which a grip hole area 76 delimited by a circumferential perforation line 74 is present. As also shown in FIG. 2, the pass through opening 16 for the clothes hanger hook of a clothes hanger is arranged substantially centrally. The pass through opening 16 can also be designed as a slot along the upper shipping bag edge 14. It has often proven expedient, however, to similarly remove parts of the front and back plastic film wall in the region of the upper shipping bag edge, by way of example in the form of a semicircle. A perspective view of a section of such an embodiment is indicated by the sectional drawing according to FIG. 3. Because the pass through opening 16 in the region of the upper shipping bag edge 14 has a certain extension in the direction of the front and back plastic film wall, the clothes hanger hook can be inserted or removed more safely and reliably without affecting, destroying or tearing the bag material.

Figure 4:
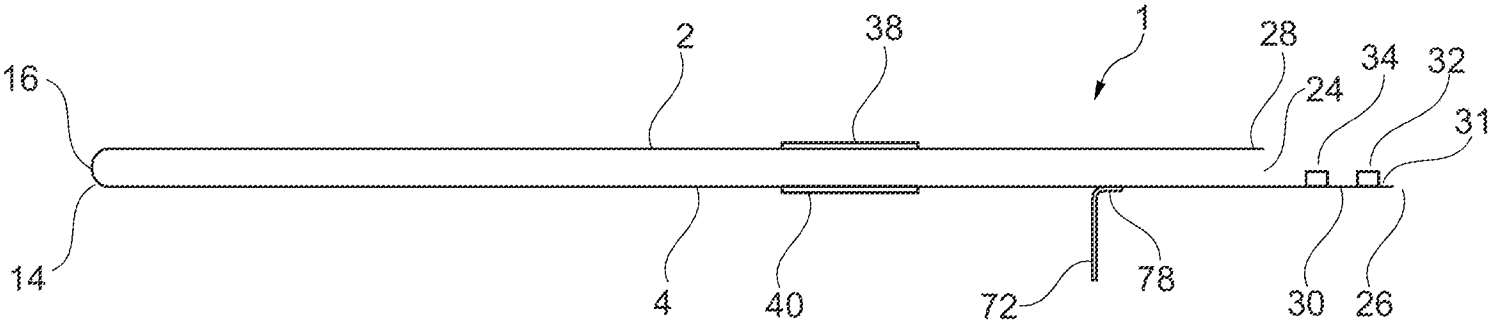
FIG. 4 is a schematic cross-sectional view of a further embodiment of a shipping bag of the present disclosure.
Figure 5:
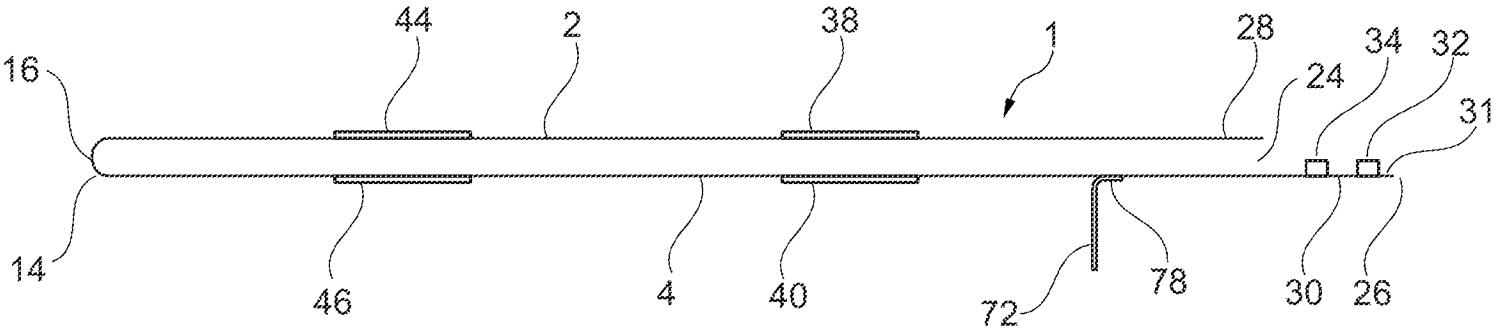
FIG. 5 is a schematic cross-sectional view of a further embodiment of a shipping bag of the present disclosure.

FIG. 4 shows a cross-sectional view through a shipping bag of the present disclosure 1 in an advantageous further development. In this embodiment, the carrying device 72 is connected via the join 78 with the section of the outside of the back plastic film wall 4, which extends between the lower end 26 or the first adhesive area 32 and a reinforced area (reference numeral 40), that lies in the folded product in a folding region. Here, the carrying device 72 is optionally arranged substantially centrally between the lower edge 26 or the first adhesive area 32 and the folding region, which substantially corresponds to the mid-section of the reinforced area 40. This embodiment also has a first reinforced area 38 and a second reinforced area 40. In the variant according to FIG. 4, these reinforced areas rest against the inside of the front and back plastic film wall 2 or 4. Of course, it is similarly possible to attach these reinforced areas on the respective outside or to design the film material to be stronger at this point. With the first and second reinforced areas it is expediently a case of plastic film strips, which are attached by gluing to the front or back plastic film wall. Of course, it is similarly possible to provide only a first or only a second reinforced area. The first and second reinforced areas are expediently present on the half of the front or back plastic film wall, which also contains the bottom opening 24. The reinforced areas 38 and/or 40 are intended to cushion a clothes hanger hook (not shown) in the folded state of the shipping bag of the present disclosure 1. In the shipping bag of the present disclosure 1, it is generally provided that an item of clothing is transported together with a clothes hanger, the clothes hanger hook of which protrudes through the pass through opening 16. To this end, the first and/or second reinforced areas 38 and 40 are optionally present in a folding portion (not shown), which limits the freedom of movement of the clothes hanger. Here, the shipping bag of the present disclosure 1 can also be provided in a length which allows multiple folding or is necessary for space-saving reasons. Accordingly, such a shipping bag 1 of the present disclosure, as shown in FIG. 5, can also have third and/or fourth reinforced areas 44 and 46. In the embodiment illustrated in FIG. 5, the shipping bag of the present disclosure 1 has both a third reinforced area 44 and a fourth reinforced area 46. These are present there, similarly on the inside of the front or back plastic film wall. If first and second or third and fourth reinforced areas are present, these are however, expediently substantially congruent but in any case partially overlapping. This further increases the reinforcing effect. It is not essential for the reinforced areas to extend from the first bag edge as far as the opposing second bag edge. In many applications, this type of attachment has proven to be highly suitable from an application or production engineering point of view.

Figure 6:
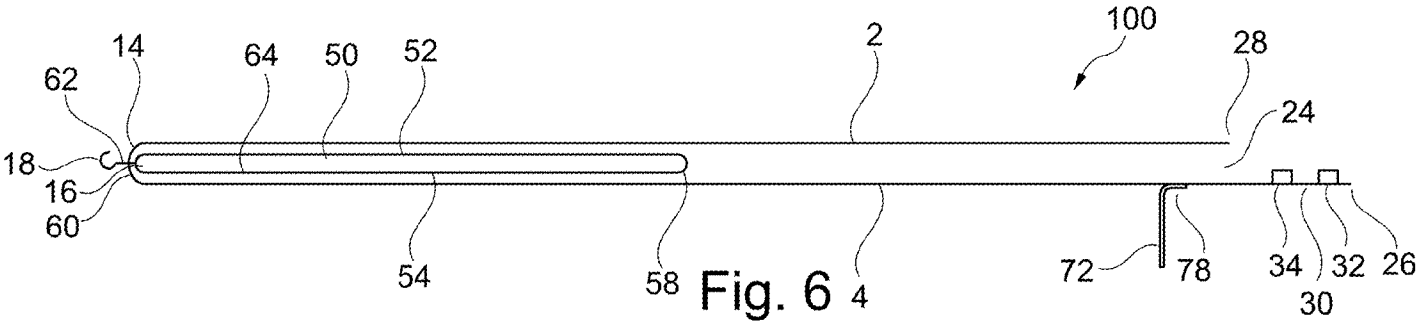
FIG. 6 is a schematic cross-sectional view of an embodiment of a shipping bag system of the present disclosure.
Figure 8:
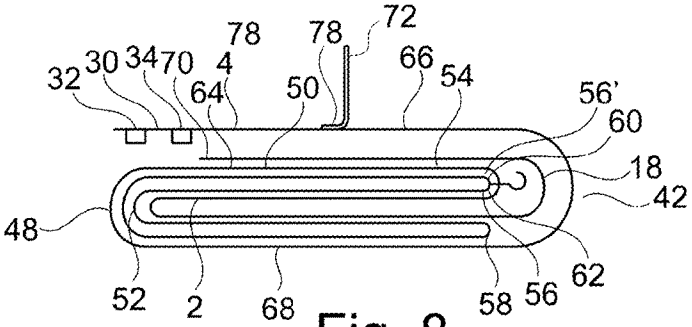
FIG. 8 is a schematic cross-sectional view of the shipping bag of the present disclosure system according to FIG. 7 in a shipping mode.

FIG. 6 shows an embodiment of a shipping bag system 100 of the present disclosure in a first configuration. As also shown in FIG. 8, here the carrying device 72 is present on the folding portion of the shipping bag system 100 of the present disclosure, having the section 30 of the back plastic film wall 4. This shipping bag system 100 comprises a shipping bag of the present disclosure 1, by way of example as shown in FIG. 1, with a front plastic film wall 2 and a back plastic film wall 4 and a section 30 of the back plastic film wall 4, protruding beyond the lower end 28 of the front plastic film wall 2. The shipping bag system 100 according to FIG. 6 also has a textile product protective cover 50 with a front wall 52 and an opposing back wall 54, an upper bag edge 60 and a lower bag edge 58. A pass through opening 62 for a clothes hanger hook is present on the upper bag edge 60 in the textile product protective cover 50. The lower bag edge 58 may be open or closed. If the lower bag edge 58 of the textile product protective cover 50 is closed, this can be the result of a one-piece design of the protective cover 50 in this region. Alternatively, in the lower region of the protective cover a suitable closure may be present, by way of example lock buttons or a zipper. Suitable closures can also be present in the front and/or the back wall.

The front and the back wall, to the extent that they extend beyond an item of clothing 64 present in the protective cover 50, may also be folded back over a section of the front or back wall covering the item of clothing.

In the embodiment illustrated in FIG. 6, in the textile product protective cover 50 an item of clothing 64 is present, which is actually suspended on a clothes hanger, the clothes hanger hook 18 of which protrudes through both the pass through opening 62 of the textile product protective cover 50 and also the overlapping, optionally substantially congruent, pass through opening 16 of the shipping bag 1. Inside, the arms of the clothes hanger rest against the upper bag edge 60 of the textile product protective cover 50. The latter upper bag edge 60 in turn rests against the upper shipping bag edge 14 of the shipping bag 1. The item of clothing 64 illustrated in FIG. 6 present in the textile product protective cover 50 may involve an unfolded or a single-, double-, or triple-folded system. Here, the fold lines optionally run substantially parallel to the upper shipping bag edge 14 and/or substantially parallel to the lower edge 28 of the front plastic film wall 2 and/or substantially parallel to the lower edge 26 of the back plastic film wall 4.

Figure 7:
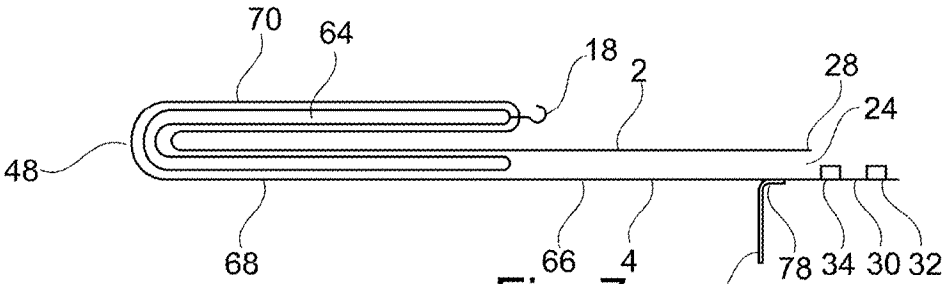
FIG. 7 is a schematic cross-sectional view of the shipping bag of the present disclosure system according to FIG. 6 in an advanced state of processing.

In order to arrive at an advantageous configuration of the shipping bag system 100 of the present disclosure, the upper section of the shipping bag system 100, as illustrated in FIG. 6, can be folded back by for instance half the length of the item of clothing 64, so that two sections of the front plastic film wall 2 come to rest on upper of one another. This is illustrated in FIG. 7. In this way, a first folding portion 70 is formed, which merges via the second folding region 48 with the second folding portion 68, which in the embodiment illustrated in FIG. 6 has not yet been fully formed. Here, it is a matter of the region of the shipping bag system 100 of the present disclosure, in which the shipping bag 1, the textile product protective cover 50 and the item of clothing 64 change direction or have a fold. In the region of the second folding region 48 in an advantageous configuration (not shown), third and/or fourth reinforced areas can be present on the front or back plastic film wall 2 or 4 of the shipping bag 1.

In order to arrive at an optimal shipping-ready shipping bag system 100, the lower section of the shipping bag 1, also referred to as a first folding portion 66, illustrated in FIG. 7, is folded back onto the third folding portion 70 to form a first folding region 42. This is illustrated in FIG. 8.

If the third folding portion 66 is folded back onto the first folding portion 70, then the advantageous, substantially optimum configuration for shipping shown in FIG. 8 of a shipping bag system 100 of the present disclosure is obtained. The clothes hanger hook 18 is present in the region of the transition from the second folding portion 68 to the third folding portion 66. This transition region, also referred to as a first folding region 42, can be provided with a first reinforced area 38 on the front plastic film wall 2 and/or with a second reinforced area 40 on the back plastic film wall 4. In the advantageous configuration of the shipping bag system 100 of the present disclosure, the clothes hanger hook 18 does not rest on an item of clothing, but beyond the lower edge of the item of clothing 64. Furthermore, the effect of the clothes hanger hook is cushioned by the first folding region 42, in some cases if this at least one reinforced area is present, optionally the first and the second reinforced area are present therein. In this way, adjacently positioned items of clothing and/or further adjacent shipping bag systems of the present disclosure remain unaffected. Because the shipping bag system 100 is reclosed by connecting the first adhesive area 32 with the outside of the back plastic film wall 4, a folded unit is obtained, which can be transported via the carrying device 72, arranged substantially centrally in this folding portion, optionally substantially horizontally.

The first and second adhesive areas 32 and 34 are present adjacent to the outside of the back plastic film wall 4 and can initially be protected by corresponding protective strips, by way of example made from siliconized paper (not shown). These protective layers can be removed shortly before the section 30 is secured to the third folding portion 66.

Figure 9:
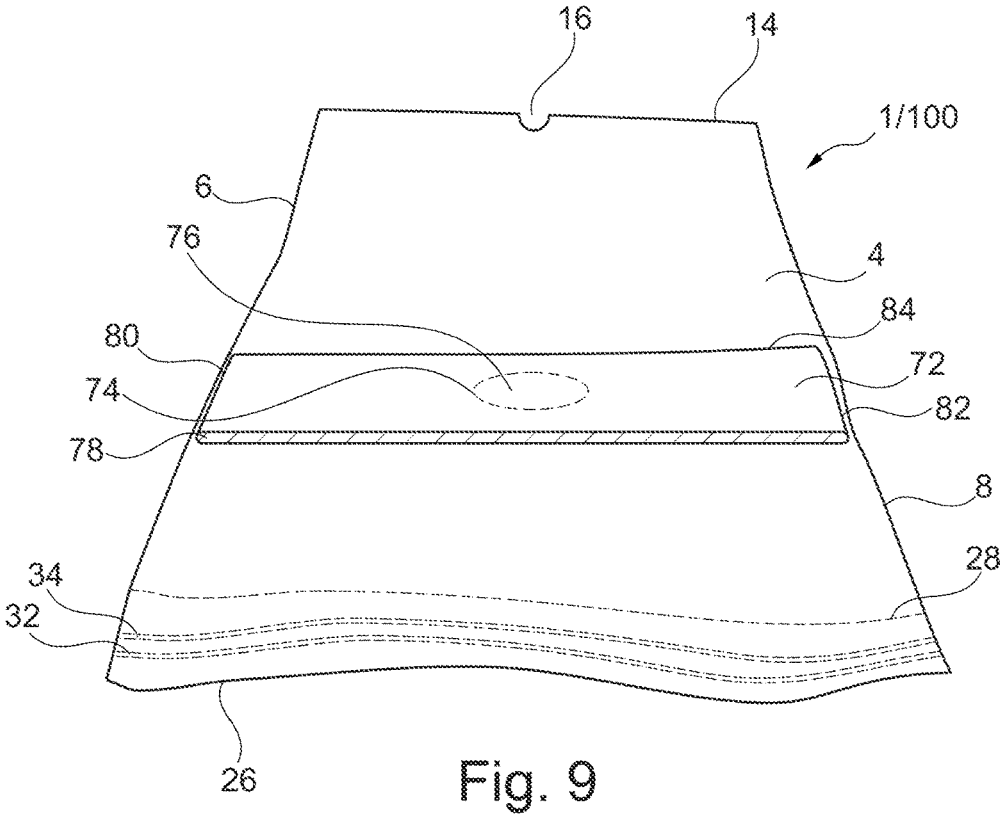
FIG. 9 is a schematic representation of an advantageous further development of the shipping bag of the present disclosure.
Figure 10:
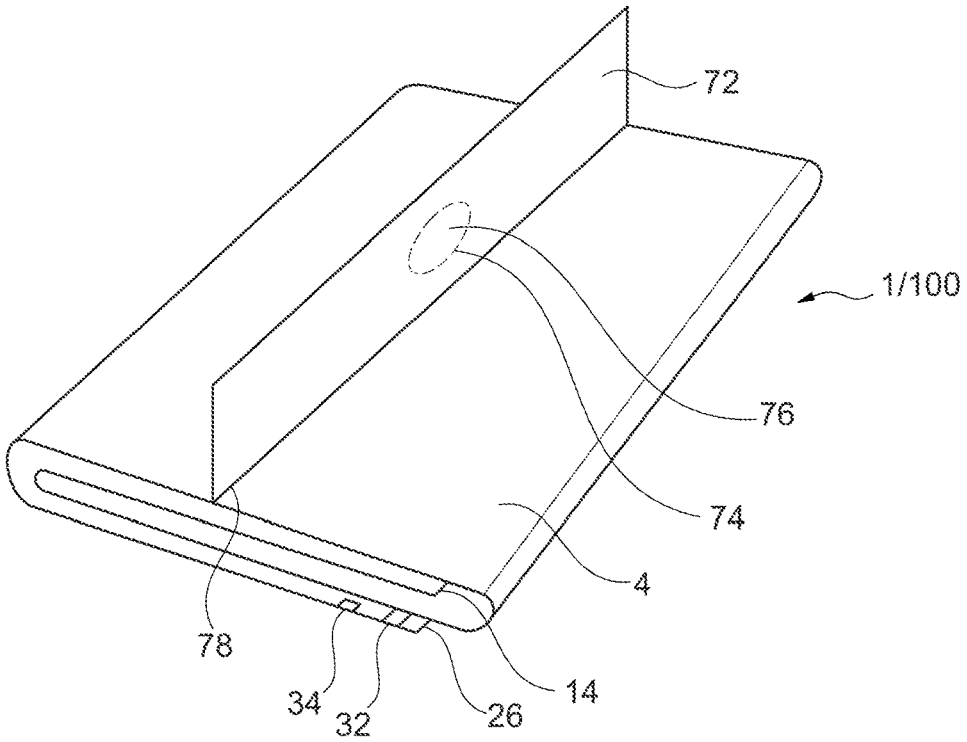
FIG. 10 is a schematic representation of the shipping bag according to FIG. 8 in folded and closed form.
Figure 11:
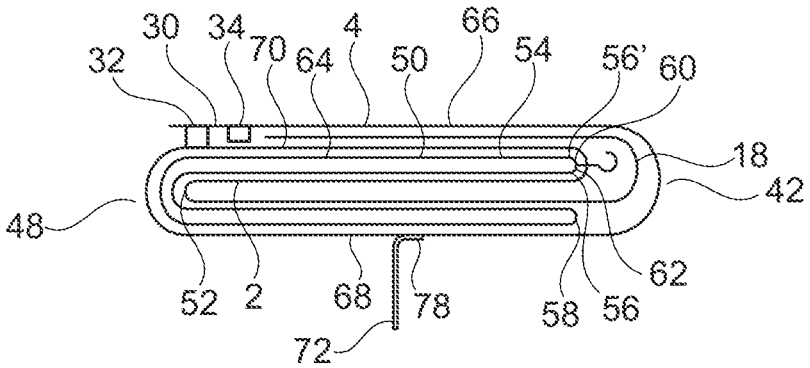
FIG. 11 is a schematic cross-sectional view of a further development of a shipping bag system of the present disclosure.

FIG. 9 shows a schematic upper view of a further development of a shipping bag of the present disclosure 1 or of a shipping bag system 100 of the present disclosure. The shipping bag 1 is, as in FIG. 1, represented in the fully unfolded state with a view of the back plastic film layer 4. The back plastic film layer 4 is delimited by the upper, closed shipping bag edge 14 and by the opposing first and second bag edges 6, 8 and the lower edge 26. The first and second adhesive areas 32, 34 are located on the inside of the section 30 of the back plastic film layer 4, which extends beyond the lower edge 28 of the front plastic film layer (in each case indicated by dashed lines). The shipping bag 1 or the shipping bag system 100 according to FIG. 9 is provided with a carrying device 72 in the form of a plastic film strip, having a perforation 74 for a grip hole area 76. The plastic film strips 72 extends substantially from the first bag edge 6 as far as the opposing second bag edge 8. In the illustrated embodiment, it is connected with the outside of the back plastic film wall 4 along a weld line 78, which can also take the form of a weld area. The section of the film strip containing the weld line or a weld area is also referred to as a first section of the film strip. Here, this weld line 78 optionally runs substantially parallel to the upper shipping bag edge 14. At the bag edges 6 and 8, the carrying device 72 in the form of the plastic film strip with the second section 86 attaching to the first section or the weld seam, rests flat against the outside of the back plastic film wall 4, but can easily be folded up or down. This is because a connection with the back plastic film wall 4 exists exclusively via the weld line or the first section 78 in the illustrated embodiment. The side edges 80 and 82 of the second section 86 of the carrying device are similarly not connected with the outside of the back plastic film wall 4 like the upper edge 84 opposing the weld seam. Here, the carrying device 72 or the weld seam 78 in the illustrated embodiment is spaced apart from the upper shipping bag edge 14 and from the lower edge 26 of the back plastic film wall 4, such that this, as shown in FIG. 10, when the shipping bag 1 or the shipping bag system 100 is folded three times to form four substantially equal length folding portions, is arranged approximately in the center of the folding portion, adjacent to the folding portion containing the section 30 with the bag opening. If the grip hole area 76 is gripped, destroying the perforation 74 and forming a grip hole, the folding portions that are adjacent and running substantially parallel to one another are automatically formed substantially horizontally. A variation of the embodiment outlined above is shown in a schematic cross-sectional view in FIG. 11. The shipping bag system 100 of the present disclosure represented therein has three folding portions and two folding regions and is based substantially on the embodiment according to FIG. 8. Unlike the embodiment according to FIG. 8, the embodiment according to FIG. 11 in the second folding portion 68 and not in the third folding portion 66 has a carrying device 72. This is substantially centrally mounted. The distance between the carrying device 72 and the opposing edges of the second folding portion 68 or the opposing, folding region delimiting the second folding portion 68 is substantially identical. In this way, when gripping the carrying device via the grip hole (not shown) the folded shipping bag system 100 is automatically substantially horizontally aligned.

Figure 12:
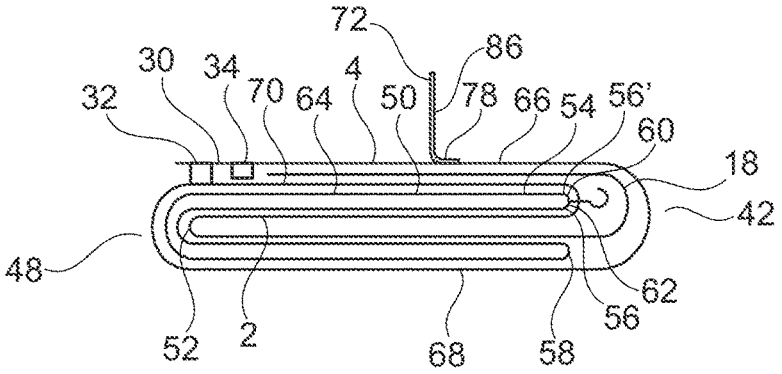
FIG. 12 is a schematic cross-sectional view of a further embodiment of a shipping bag system of the present disclosure.

FIG. 12 shows a schematic cross-sectional view of an advantageous further development of a shipping bag system 100 of the present disclosure. Unlike the embodiment according to FIG. 8, with the embodiment according to FIG. 12 the carrying device 72 in the form of a film strip in the region of the edge or first section 78 of this film strip is welded to the outside of the back plastic film wall 4 (first section of the plastic carrying device), such that the second section 86 of the film strip which is not welded, in a deviation from the embodiments according to, for example, FIGS. 2 and 4 to 9, attaches to the first section 78 in such a way that this points in the direction of the lower edge 26 of the back plastic film wall 4 and can be positioned against the outside of the back plastic film wall with this alignment, without overlapping the first section 78. This means that the side of the plastic strip that in the first section is welded to the outside of the back plastic film wall, is also the side which in the second section 86 of the film strip is turned towards and can be placed against this.

Figure 13:
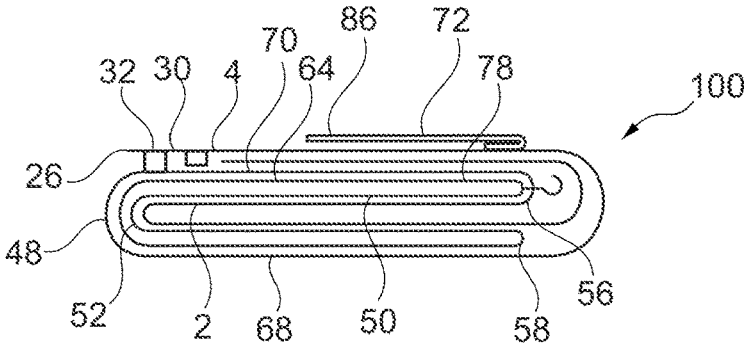
FIG. 13 is a schematic cross-sectional view of the embodiment of a shipping bag system of the present disclosure in the folded state.
Figure 14:
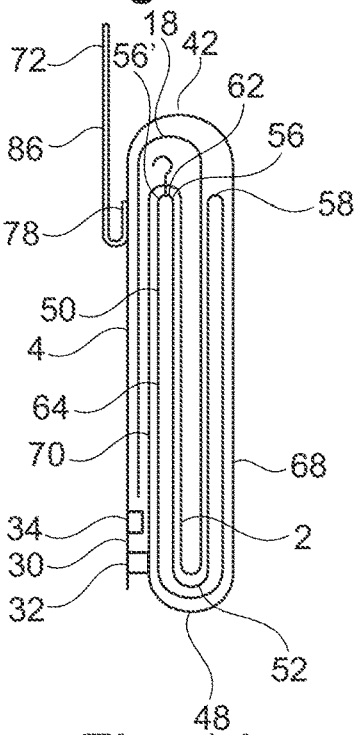
FIG. 14 is a schematic representation of the embodiment according to FIG. 13 in generic use.

Furthermore, the carrying device 72 in the form of the film strip is, in an advantageous configuration mounted on the outside of the back plastic film wall 4 in such a way that, as shown in FIG. 13, the join or weld is present in the upper part of the folding portion, of the section 30 protruding beyond the lower edge of the front wall. In this way, the shipping bag or the folded shipping bag system in generic use can also be carried in vertical alignment, as illustrated in FIG. 14. Here, it is advantageous that the carrying device 72 via its first section 78 is not present in the crown of the folding region, but is slightly offset in the direction of the lower edge 26 of the back plastic film wall 4. This allows safe and reliable carrying in the vertical state, without the item of clothing present in the shipping bag losing its shape or wrinkling. Provided it is not used as a carrying device, the second section 86 does not rest around the folding region, but rests flat against the folding portion containing the section 30. This is of some cases advantage during transport by shipping companies.

The features of the present disclosure disclosed in the above description, the claims, and the drawings, can be advantageous both individually and in any combination in realizing the present disclosure.

The invention claimed is:

1. A carriable shipping bag containing a closable bottom opening with a front plastic film wall and a back plastic film wall, each with opposing side edges, a upper edge and a lower edge, wherein the front plastic film wall and the back plastic film wall are connected with one another or merge into one another as one piece along their corresponding side edges at least in sections to form opposing first and second bag edges and/or wherein the front plastic film wall and the back plastic film wall are connected with one another via a first side wall or first side wall sections and/or via an opposing second side wall or second side wall sections, wherein the front plastic film wall and the back plastic film wall are connected with one another along their corresponding upper edges directly or indirectly or merge into one another as one piece and form a upper shipping bag edge, wherein the lower edge of the back plastic film wall extends beyond the lower edge of the front plastic film wall and wherein this section of the back plastic film wall extending beyond the lower edge of the front plastic film wall has on its inside at least one first adhesive area, which extends or is spaced apart from one side edge in the direction of or as far as the opposing side edge, wherein this section of the back plastic film wall is designed and configured to be secured to the outside of the front or back plastic film wall folding over and/or via the at least one adhesive area, to close the bottom opening, and wherein the upper shipping bag edge has a pass through opening, the shipping bag further comprising at least one carrying device secured to or as part of the front and/or back plastic film wall and/or secured to the opposing side edges of the front and/or back plastic film wall and/or secured to the first and second bag edges, wherein the front plastic film wall and the back plastic film wall are based on a continuous section of a plastic film, wherein the upper shipping bag edge is an integral one-piece component of said continuous section of the plastic film, wherein the carriable shipping bag further comprises:

spaced apart from the first adhesive area, and spaced further apart from the lower edge of the back plastic film wall than the first adhesive area, at least one second adhesive area on the inside on the section of the back plastic film wall extending beyond the lower edge of the front plastic film wall, wherein this second adhesive area extends or is spaced apart from one side edge in the direction of or as far as the opposing side edge and wherein the bottom opening is closable by the second adhesive area by securing to the outside of the back plastic film wall, and a weakened zone arranged between the first adhesive area and the lower edge of the back plastic film wall, wherein the first adhesive area runs substantially parallel to the lower edge, and/or to a weakened zone arranged between the first and the second spaced-apart adhesive areas, wherein the second adhesive area runs substantially parallel to the first adhesive area, wherein the shipping bag, in folded form, has n folding portions, folded along folding region(s), extending from or extending spaced apart from one side edge in the direction of or as far as the opposing side edge, wherein n=2, 3, 4, 5, 6, 7 or 8, and wherein the folding region(s) run substantially parallel to the upper shipping bag edge and/or the lower edge of the back plastic film wall and/or the lower edge of the front plastic film wall, wherein:

a) the at least one carrying device forms part of or is secured to the folding portion which contains the section of the back plastic film wall extending beyond the lower edge of the front plastic film wall, or b) the at least one carrying device forms part of or is secured to the folding portion which is adjacent to the folding portion which contains the section of the back plastic film wall extending beyond the lower edge of the front plastic film wall, or c) the at least one carrying device forms part of or is secured to the folding region which is present between the folding portion which contains the section of back plastic film wall extending beyond the lower edge of the front plastic film wall, and the folding portion adjacent to this, or d) the at least one carrying device forms part of or is secured to the folding region adjacent to the folding region according to feature c) above, and wherein the at least one first and/or second adhesive area, in the folded state of the shipping bag system, is connectable to or connected with the folding portion containing the upper shipping bag edge, or is connectable to or connected with the folding portion adjacent to the folding portion containing the upper shipping bag edge.

2. The shipping bag of claim 1, wherein the front plastic film wall and/or the back plastic film wall constitute an at least three-ply plastic film composite.

3. The shipping bag of claim 2, wherein the plastic film composite is based on polyethylene film layers.

4. The shipping bag of claim 1, further comprising a clothes hanger with a clothes hanger securing device and with clothes hanger arms extending in opposite directions from the clothes hanger securing device, wherein the clothes hanger securing device, is present in the pass through opening and wherein the clothes hanger arms, on the inside, are present adjacent to or rest against the upper shipping bag edge or an upper wall strip that connects the front plastic film wall and the back plastic film wall along their corresponding upper edges.

5. The shipping bag of claim 1, further comprising:

at least one first reinforced area extending from or extending spaced apart from one side edge of the front plastic film wall in the direction of or as far as the opposing side edge, and/or at least one second reinforced area extending from or extending spaced apart from one side edge of the back plastic film wall in the direction of or as far as the opposing side edge, wherein the first and/or second reinforced areas are spaced closer to the lower edge of the front plastic film wall than to the upper shipping bag edge in a lower, first folding region of the shipping bag, and/or further comprising at least one third reinforced area extending from or extending spaced apart from one side edge of the front plastic film wall in the direction of or as far as the opposing side edge, and/or at least one fourth reinforced area, extending from or extending spaced apart from one side edge of the back plastic film wall in the direction of or as far as the opposing side edge, wherein the third and/or fourth reinforced areas are spaced closer to the upper shipping bag edge than to the lower edge of the front plastic film wall in an upper, second folding region of the shipping bag, wherein the first and/or second and/or third and/or fourth reinforced areas is/are an integral component of the front or back plastic film wall or is/are present on the outside and/or inside of the front plastic film wall or on the outside and/or inside of the back plastic film wall.

6. A shipping bag system, comprising:

a carriable shipping bag of claim 1; and a textile product protective cover with a front and a back wall, respectively opposing side edges, a upper edge, and a lower edge, wherein the front and back wall, along their corresponding side edges, in each case are connected with one another or merge into one another as one piece directly or indirectly at least in sections and, along their corresponding upper edges, are connected with one another or merge into one another as one piece directly or indirectly at least in sections and form a upper bag edge, wherein the upper bag edge has an pass through opening for a clothes hanger securing device of a clothes hanger.

7. The shipping bag system of claim 6, wherein the textile product protective cover is present or can be arranged at least in parts or completely in the shipping bag, wherein the front wall of the textile product protective cover is adjacent or can be arranged adjacent to the front plastic film wall of the shipping bag and wherein the back wall of the textile product protective cover is adjacent or can be arranged adjacent to the back plastic film wall of the shipping bag, wherein the upper bag edge of the textile product protective cover can be arranged adjacent or is adjacent to or rests on the upper shipping bag edge of the shipping bag and wherein the pass through opening of the textile product protective cover and the pass through opening of the shipping bag can be or are arranged to overlap at least partially.

8. The shipping bag system of claim 6, further comprising a clothes hanger with a clothes hanger securing device and with clothes hanger arms extending in opposite directions from the clothes hanger securing device, wherein the clothes hanger securing device is present in the pass through openings of the textile product protective cover and of the shipping bag and wherein, on the inside, the clothes hanger arms are present adjacent to or rest against the upper bag edge of the textile product protective cover.

9. The shipping bag system of claim 8, further comprising a textile product attached to the clothes hanger selected from the group consisting of jackets, coats, tailcoats, trousers, suits, dresses, overcoats, shirts, blouses, shawls, T-shirts or pullovers, wherein the clothes hanger securing device is present in the pass through openings of the shipping bag and the textile product protective cover.

10. The shipping bag system of claim 6, wherein the shipping bag and if applicable the textile product protective cover has n folding portions formed by n−1 folds or folding regions, wherein n=2, 3, 4, 5, 6, 7 or 8.

11. The shipping bag system of claim 10, wherein:

a first folding portion extending from the upper shipping bag edge as far as or in the direction of the spaced-apart second folding portion, a second folding portion adjoining the first folding portion or the second folding region extending substantially as far as the lower edge of the textile product protective cover or the lowermost fold of the textile product protective cover or the lower edge of the textile product or the first folding region or beyond this, and a third folding portion extending substantially from the lower edge of the textile product protective cover or the lowermost fold of the textile product protective cover as far as the section of the back plastic film wall extending beyond the lower edge of the front plastic film wall, or if applicable an $n^{th}$ folding portion extending substantially from the lower edge of the textile product protective cover or the lowermost fold of the textile product protective cover as far as the section of the back plastic film wall extending beyond the lower edge of the front plastic film wall.

12. The shipping bag system of claim 11, wherein:

said first folding portion extends from the upper shipping bag edge as far as the second folding region, said third folding portion extends substantially from second folding portion or the first folding region, as far as the section of the back plastic film wall extending beyond the lower edge of the front plastic film wall, or said an $n^{th}$ folding portion extends substantially from the $(n-1)^{th}$ folding portion or the $(n-2)^{th}$ folding region as far as the section of the back plastic film wall extending beyond the lower edge of the front plastic film wall.

13. The shipping bag system of claim 10, wherein the clothes hanger securing device in a folded state is present beyond the lower edge or the lowermost fold or the lowermost folding region of the textile product protective cover or the lower edge of the item of clothing and in the region of the first folding region.

14. The shipping bag system of claim 10, wherein n is 2, 3 or 4.

15. The shipping bag of claim 1, wherein:

all folding portions have substantially the same average extension between respectively adjacent folding regions, or all folding portions except for the folding portion containing the section of the back plastic film wall extending beyond the lower edge of the front plastic film wall have substantially the same average extension between respectively adjacent folding regions, or all folding portions except for the folding portion containing the section of the back plastic film wall extending beyond the lower edge of the front plastic film wall and the folding portion containing the upper shipping bag edge have substantially the same average extension between respectively adjacent folding regions, or all folding portions except for the folding portion containing the upper shipping bag edge have substantially the same average extension between respectively adjacent folding regions.

16. The shipping bag of claim 1, wherein the at least one carrying device comprises a plastic film strip containing a grip hole or an area fully or partially circumferentially perforated to form a grip hole, or at least one carrying loop, wherein the plastic film strip or the at least one carrying loop is configured and designed so that it can be positioned on a folding portion without protruding into a folding region.

17. The shipping bag of claim 16, wherein the carrying device in the form of a plastic film strip is connected with the outside of the back plastic film wall via its side turned towards the outside of the back plastic film wall in a first section extending from or extending spaced apart from the first bag edge in the direction of or as far as the second bag edge, and wherein a second section of the film strip adjoins the first section and contains the grip hole or the area forming a grip hole or the at least one carrying loop.

18. The shipping bag of claim 17, wherein the first section of the carrying device connected with the outside of the back plastic film wall extends from the first to the second bag edge or between the first and the second bag edge.

19. The shipping bag of claim 17, wherein the first section of the carrying device in the form of a plastic film strip is turned towards the lower edge of the front or back plastic film wall or the upper shipping bag edge and is a component of a lower or upper edge section of the carrying device or forms the lower or upper edge section of the carrying device.

20. The shipping bag of claim 17, wherein the first section has a first, lower edge limit turned towards the lower edge of the back plastic film wall, and an opposing second edge limit, turned towards the upper shipping bag edge, and wherein the second section of the carrying device adjoins the first, lower edge limit of the carrying device.

21. The shipping bag of claim 17, wherein:

the shipping bag or shipping bag system is present in folded form, the first section of the carrying device is present on the folding portion containing the section of the back plastic film wall extending beyond the lower edge of the front plastic film wall, wherein this first section is present adjacent to the folding region adjoining this folding portion, or the first section of the carrying device is present adjacent to the folding portion containing the section of the back plastic film wall extending beyond the lower edge of the front plastic film wall, wherein this first section is present in the transition between this folding portion and the folding region adjoining this or in this folding region, on this side of or beyond the crown of the folding region and turned towards the folding portion containing the section of the back plastic film wall extending beyond the lower edge of the front plastic film wall, or the first section of the carrying device is present on the folding portion adjacent to the folding portion containing the section of the back plastic film wall extending beyond the lower edge of the front plastic film wall, wherein this first section is adjacent to the folding region which extends between this folding portion and the folding portion containing the section of the back plastic film wall extending beyond the lower edge of the front plastic film wall.

22. The shipping bag of claim 1, wherein the at least one carrying device is configured and arranged in a way in which overlying folding portions of the folded and closed shipping bag are carried aligned more horizontally than vertically during generic use.

23. The shipping bag of claim 1, wherein:

the front plastic film wall and the back plastic film wall are connected with one another by way of welding or merge into one another as one piece along their corresponding side edges at least in sections to form opposing first and second bag edges and/or wherein the front plastic film wall and the back plastic film wall along their corresponding side edges are connected with one another via a first side wall or first side wall sections and/or via an opposing second side wall or second side wall sections, and the front plastic film wall and the back plastic film wall are connected with one another along their corresponding upper edges by way of welding directly or indirectly or merge into one another as one piece and form a upper shipping bag edge.

24. The shipping bag of claim 1, wherein:

the front plastic film wall and the back plastic film wall are connected with one another along their corresponding upper edges via an upper wall strip and/or wherein said pass through opening of the upper shipping bag edge is located substantially centrally and/or said at least one carrying device is secured to or as part of the back plastic film wall and/or secured to the opposing side edges of the back plastic film wall and/or secured to the first and second bag edges.

* * * * *